US006233997B1

(12) United States Patent
Quittmann et al.

(10) Patent No.: US 6,233,997 B1
(45) Date of Patent: May 22, 2001

(54) METAL-EXTRUSION PRESS

(75) Inventors: Uwe Quittmann, Willich; Valentin Gala, Mönchengladbach, both of (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 09/593,616

(22) Filed: Jun. 13, 2000

(30) Foreign Application Priority Data

Jun. 14, 1999 (DE) ..... 199 27 106

(51) Int. Cl.[7] ..... B21C 23/20
(52) U.S. Cl. ..... 72/265; 72/253.1; 72/462
(58) Field of Search ..... 72/253.1, 264, 72/265, 272, 273, 462, 467, 455, 456; 100/226, 269.2, 295

(56) References Cited

U.S. PATENT DOCUMENTS 5,511,450 * 4/1996 Nagao ..... 72/467
5,855,135 * 1/1999 Howe ..... 72/253.1
5,878,616 * 3/1999 Kulakov et al. ..... 72/265

FOREIGN PATENT DOCUMENTS 62-57713 * 3/1987 (JP) ..... 72/253.1

OTHER PUBLICATIONS

"Hydraulische Horizontale Strang–Und Rohrpressen"; Walter Dohrn et al; DK621.774.385.82; 8 pages.

* cited by examiner

*Primary Examiner*—Ed Tolan
(74) *Attorney, Agent, or Firm*—Herbert Dubno

(57) ABSTRACT

A frame-like traveling beam carrying a hollow press ram of a metal extrusion press and in which a traverse carrying a piercing mandrel is guided, has the side walls of that traveling beam progressively reduced toward a midpoint from each end along the guide path of the traverse. Surprisingly that reduces the spread of the side walls under load and limits the degree to which the mandrel may be guided eccentrically.

2 Claims, 4 Drawing Sheets

METAL-EXTRUSION PRESS

FIELD OF THE INVENTION

Our present invention relates to a metal-extrusion press, particularly a tube and billet press of the type in which a press ram is hydraulically actuated to drive a billet through the die and a piercing mandrel within the ram is actuatable to form a passage through the extruded material in the production of extruded tubing.

BACKGROUND OF THE INVENTION

In metal-extrusion processes of the type wherein a billet of a material such as aluminum or copper is extruded by a press ram through a die and a piercing mandrel is displaceable within that ram to form a passage in the extruded product in the production of extruded metal tubing, it is common for the hollow press ram to be carried by a traveling beam which serves to receive and guide the piercing mandrel which passes through the press ram. That piercing mandrel is normally carried by a traverse which itself is guided in the traveling beam and which, in turn, is connected to a piercing piston which can be guided or disposed in part in the main press piston coupled with the traveling beam.

In the production of tubing from, for example, extrudable metals like aluminum and copper by extrusion press methods, both direct and indirect extrusion presses are used. The direct press is, however, the predominant apparatus for this purpose. An important characteristic of the direct extrusion press is that the die and the receiver are fixed with respect to one another. By contrast, in an indirect extrusion press, the die penetrates into the receiver. The die then has a hollow ram fitted at its head with a die holder carrying the die. On one side the receiver is sealed by a closure member.

The billet and tube press of this type and the pressing programs for operating same with a variety of materials are described for example in "Sonderdruck aus Zeitschrift für Metallkunde 51 (1960) 2, pages 3 to 10".

In the operation of such direct or indirect billet and tubing presses it has been found that the traveling beam during production, because of the axial pressing forces, is stressed in compression. This gives rise to a spreading or bulging at approximately the center of the two opposite side walls of the frame-like traveling beam. Since the piercing mandrel traverse is guided between these side walls, it is almost impossible in practice to prevent a shift in the position of the traverse off center. With such shifting of the guide surfaces for the traverse, the passage formed in the product tends to be eccentric and narrow fabrication tolerances of the tubing produced cannot be effectively maintained.

OBJECTS OF THE INVENTION

It is, therefore, the principal object of the present invention to provide a billet and tubing press of the type described which is free from the drawbacks noted.

More specifically it is an object of the invention to provide a billet and tubing extrusion press whose fabrication tolerances can be maintained in spite of compressive stresses on the traveling beam.

It is also an object of the invention to provide a billet and tubing extrusion press which has a reduced tendency toward eccentricity of the piercing mandrel.

SUMMARY OF THE INVENTION

These objects and others which will become apparent hereinafter are attained, in accordance with the invention, by narrowing the cross sections of the side walls or frame members of the traveling beam, especially toward the exterior so that the minimum beam wall cross section is located generally centrally of the lengths of the side walls guiding the traverse carrying the piercing mandrel.

It has been found, quite surprisingly, that such narrowing or reduction in the cross section of the side walls toward the center from the ends of the side wall portions guiding the mandrel-carrying traverse reduces dramatically the spread of the side wall under compression and thereby the eccentricity which can develop for the traverse and the piercing mandrel itself.

More particularly, a metal-extrusion press of the invention can comprise:

an extrusion die;

a hollow press ram movable toward said die;

a traveling beam elongated in a direction of displacement of said hollow press ram, carrying said hollow press ram and movable toward and away from said die;

a piercing mandrel extending through said hollow press ram and carried by a traverse guided in said traveling beam, said traveling beam having side walls framing said traverse on opposite sides thereof over a path of said traverse in said traveling beam; and a main piston acting upon said traveling beam for displacing same toward said die, said side walls having recessed exteriors and being of a cross section diminishing from each end toward an intermediate region whereby, upon longitudinal stressing of said traveling beam for extrusion of a billet eccentricity of said ram is reduced.

The traveling beam is shaped using the finite-element method "FEM" and tests have shown that by reducing the cross section of the side walls and especially by imparting to the outer contour of the side wall a curvilinearly-concave shape, i.e. a concave outward configuration, the spread or outward bulging of these side walls can be significantly reduced. This is the opposite of what would be expected since it has hitherto been thought that the best way to avoid outward spread or bulging or deformation generally was to make a wall thicker or more massive. The reduced thickness side walls of the invention, under compressive stress, have been found to provide practically straight-line generatrices or guide surfaces for the traverse along the interior of the traveling beam over practically the entire stroke of the traverse and range of compressive forces applied to the traveling beam.

The exterior of the traveling beam has a concave outer contour which continuously receives from either end of the side wall in terms of the length of travel within the beam of the traverse. The curvature of the concavity can follow a circular arc, a catenary or a similar curve. It may, however, also conform to a polygon defined by a multiplicity of straight line segments.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
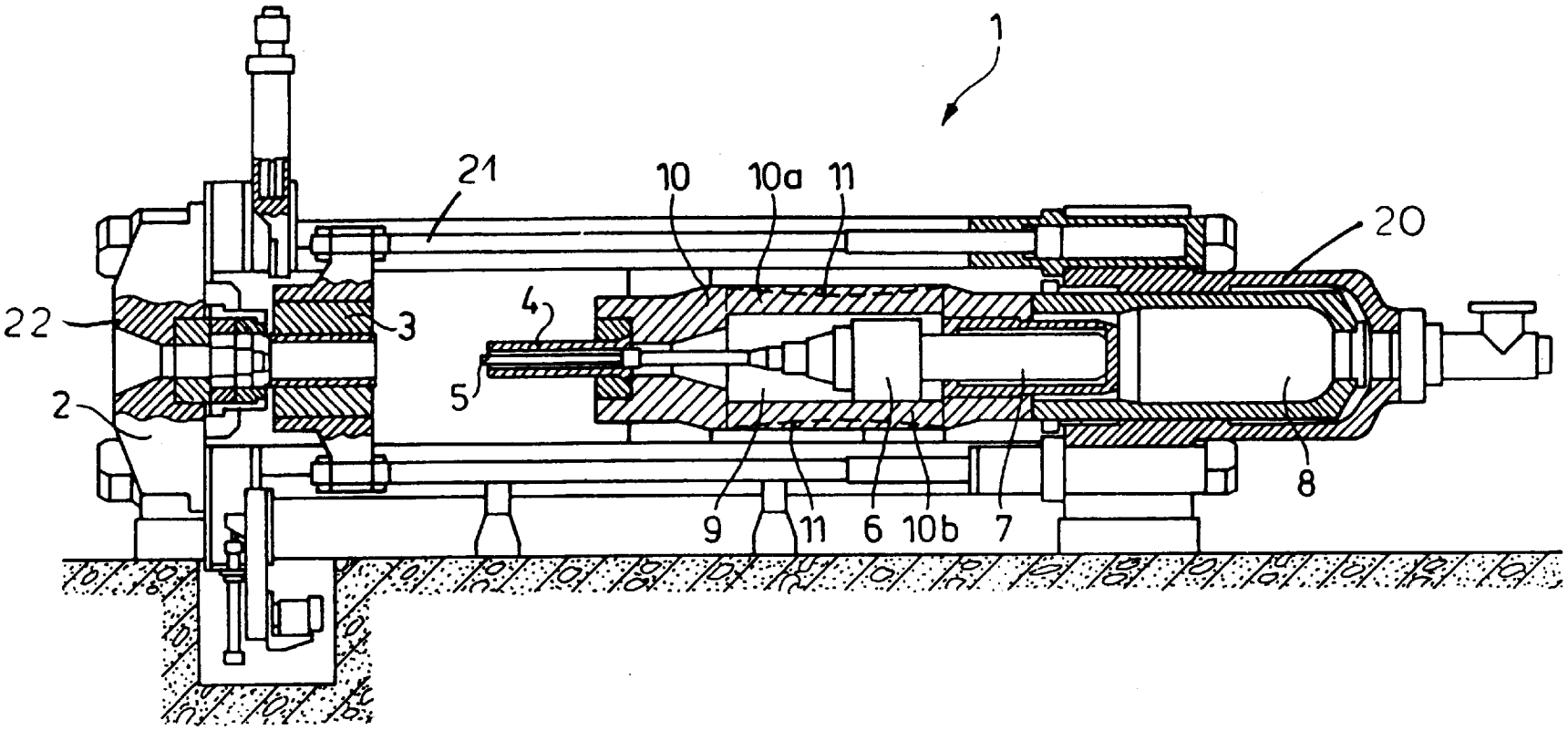
FIG. 1 is a longitudinal section through a billet and tube metal-extrusion press according to the invention.

A direct billet and tube-extrusion press has been illustrated by way of example in FIG. 1 and comprises a counterbeam 2 provided with a die in a block receiver 3, a hollow press ram 4 and a piercing mandrel 5.

The main press piston 8 in a cylinder 20 connected to the block receiver 3 by tie rods 21, serves to generate the main press pressure. The resulting press pressure forces the billet through the die and the product is pierced by the mandrel 5 so that, emerging at the downstream end 22 of the press is an extruded tube.

The piercing mandrel 5 extends through the hollow press ram 4 and is carried by a piercing mandrel traverse 6 having a piston 7 guided in the piston 8 and capable of displacing the traverse 6 in a hollow or chamber 9 of a frame-shaped traveling beam 10 carrying the hollow press ram 4 and displaced by the piston 8.

Figure 3A:
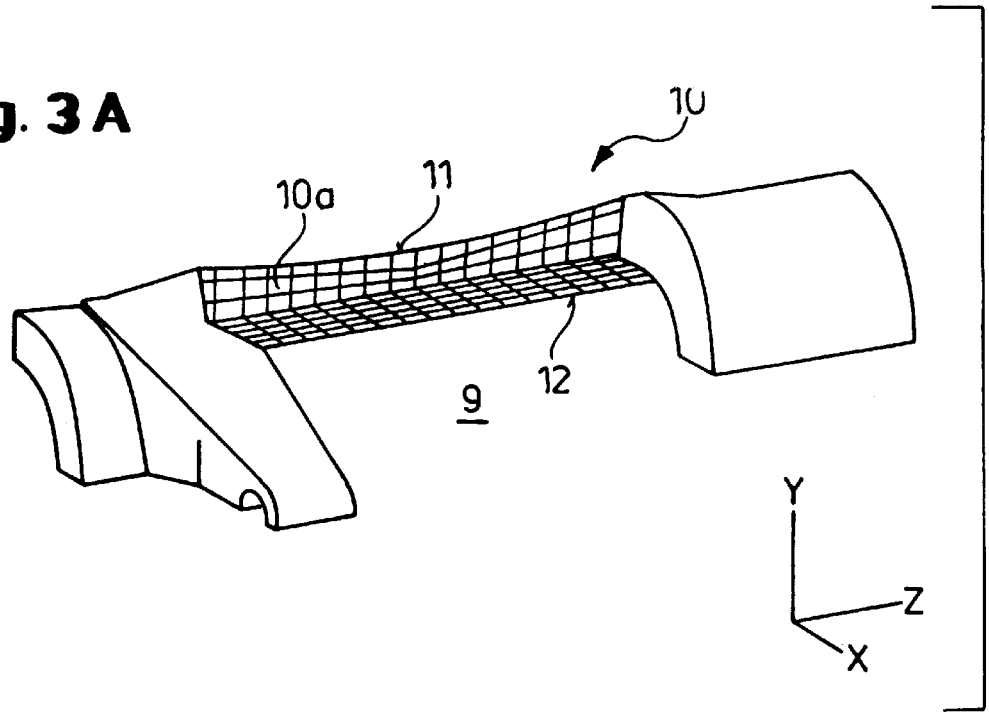
FIG. 3A is a detail similar to FIG. 2A in which the side walls are of progressively diminishing cross section or thickness toward the center in accordance with the invention.
Figure 3B:
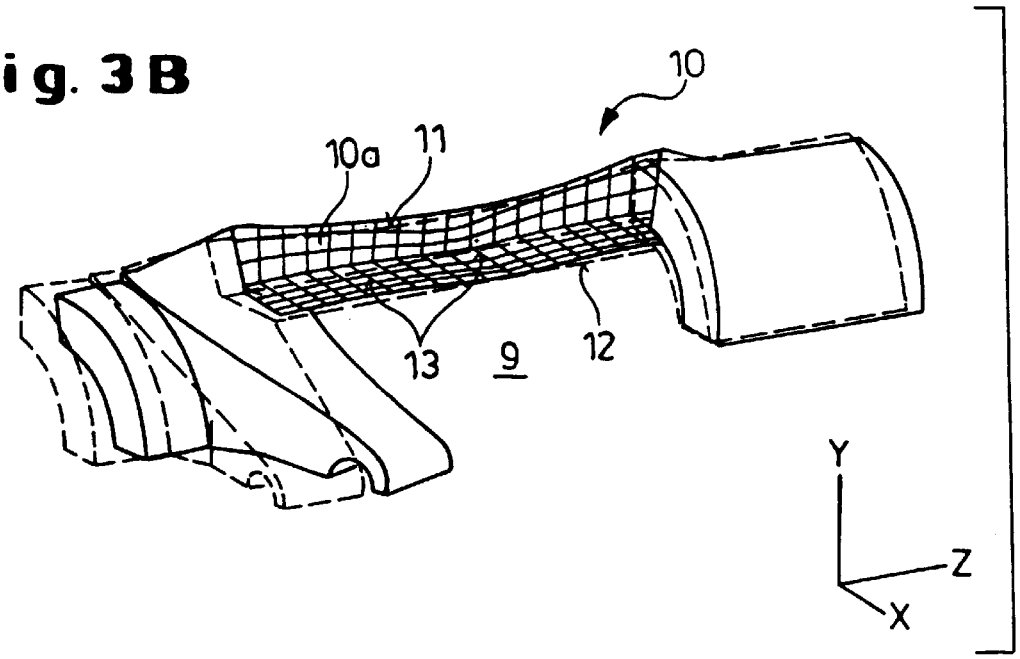
FIG. 3B is a view similar to FIG. 3A but showing the shape of the traveling beam under longitudinal compression or load.

The opposite sides of the recess 9 are defined by side walls 10*a,* 10*b* of the traveling beam 10 and are formed on their outer sides or surfaces with upwardly and downwardly concave cross sectional reductions 11 represented by the circular arc segmental broken line in FIG. 1 (see also FIGS. 3A and 3B).

Figure 2A:
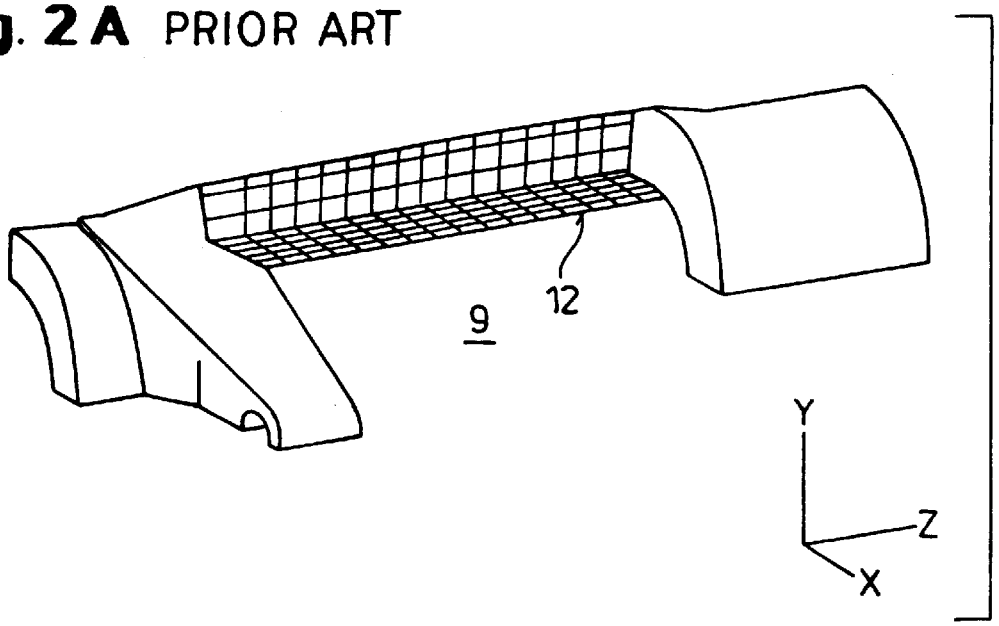
Fig. 2A PRIOR ART
FIG. 2A is a broken away perspective view showing a detail in simplified form of the traveling beam in an unleaded state thereof.
Figure 2B:
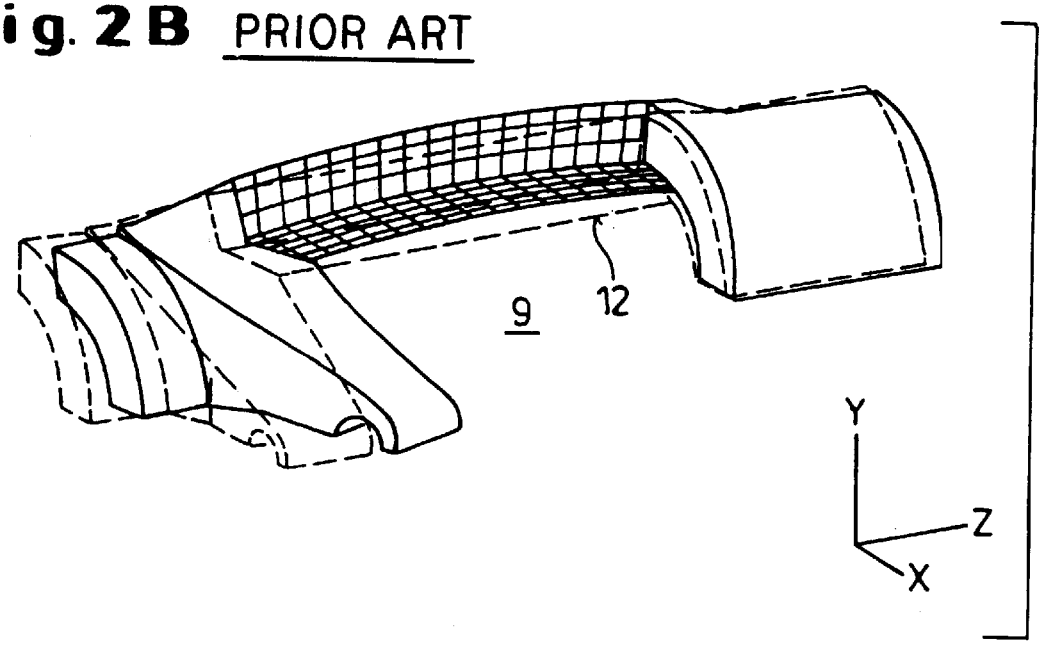
Fig. 2B PRIOR ART
FIG. 2B is a view similar to FIG. 2A but showing the traveling beam under longitudinal stress or load.

FIGS. 2A and 2B show in a simplified three-dimensional illustration the conventional construction of a traveling beam of a billet and tube-extrusion press over the length of the chamber or hollow 9 which can represent the length of the stroke of the traverse 6 within the traveling beam. As can be seen from FIGS. 2A and 2B the conventional traveling beam has the cross section of the side walls uniform over the length of the stroke of the traverse 6. The unloaded state is shown in FIG. 2A and the configuration of the traveling beam on the load, i.e. under axial compression from the force generated by the main piston 8, is shown in FIG. 2B. Under load, the side walls bulge outwardly and in the illustration of FIG. 2B, upwardly. The nature of the bulge is illustrated in FIG. 2B in which the starting position is shown in broken lines at 12. It is thus easily understandable why the position of the piercing mandrel traverse 6, guided along the interior surfaces of the side walls 10*a* and 10*b* is shifted out of center.

By comparison, FIGS. 3A and 3B show the traveling beam according to the invention with the concavity along their interior surfaces reaching the thinnest wall and narrowest wall cross section at the center of the length of the side walls and thus of the travel of the traverse 6. Because of the cross sectional narrowing of the side walls represented at 11, under the press force generated any outward deformation is substantially reduced (compare broken lines 12 in FIG. 3B).

Figure 4:
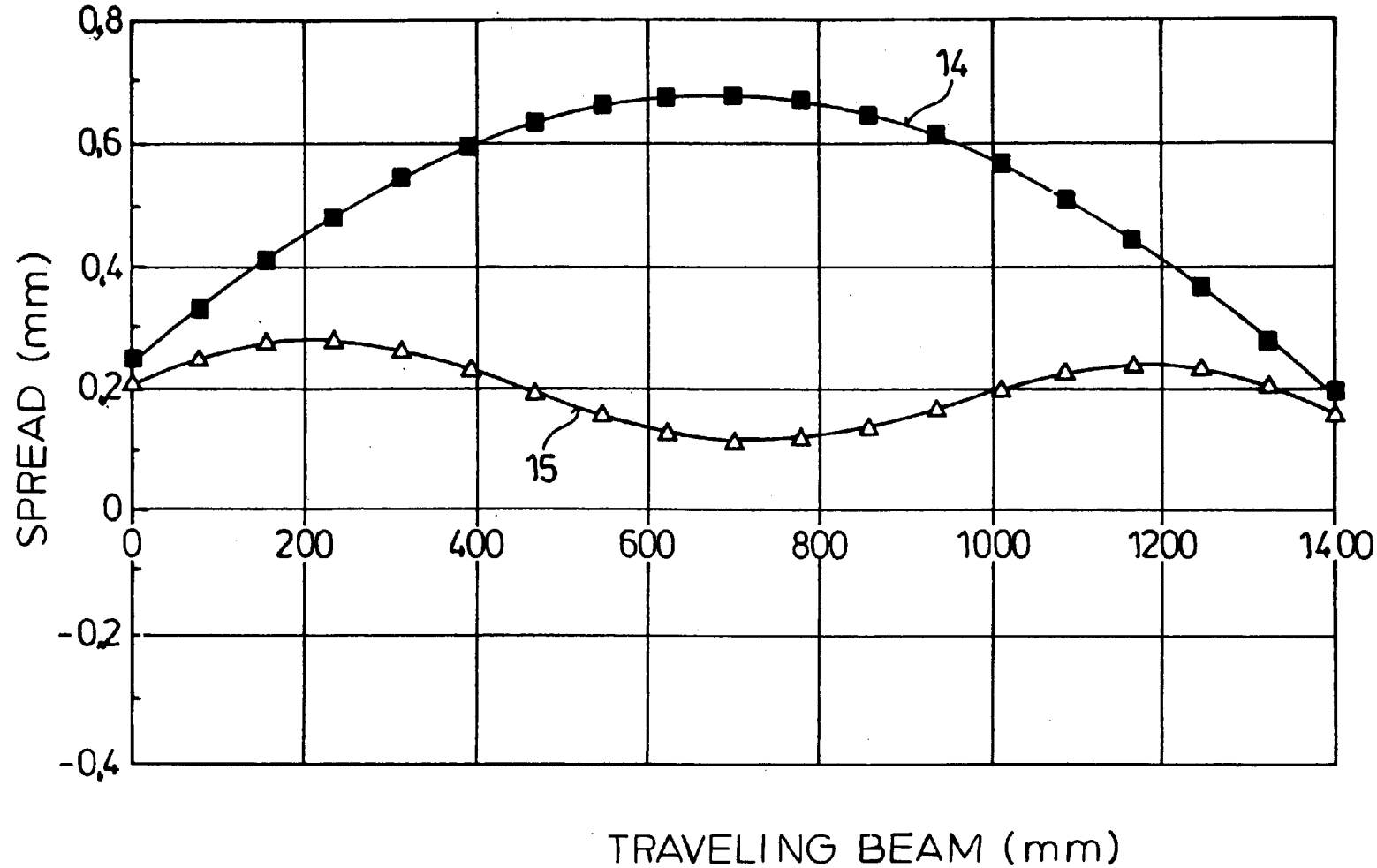
FIG. 4 is a graph of the spread or bulging of the side walls of the traveling beam, plotted along the ordinate verses length of the traveling beam plotted along the abscissa for the traveling beam of a metal-extrusion press under load for the curvature provided in FIG. 3A.

The stress lines 13 run similarly to those shown in FIG. 2B but remain practically linear in the construction of the invention provided with the concavity. Since there is practically no significant outward bulging, the traverse 6 is guided over its entire length without deviation from its intended path. This can be understood from FIG. 4 in which the spread of the side walls is plotted in millimeters along the ordinate verses the length of the traveling beam in millimeters along the abscissa. The curve 14 gives the spread for a conventional traveling beam whereas the curve 15 gives the reduced spread for a traveling beam with the reduced cross section of the side walls 10*a* and 10*b* as has been illustrated in FIG. 3B.

The press of FIG. 1 is modified as shown in FIGS. 3A and 3B, operates with reduced tolerances with respect to the tubular product but in the conventional manner for extrusion of tubing of copper and aluminum.

We claim:

1. A metal-extrusion press comprising:

an extrusion die;

a hollow press ram movable toward said die;

a traveling beam elongated in a direction of displacement of said hollow press ram, carrying said hollow press ram and movable toward and away from said die;

a piercing mandrel extending through said hollow press ram and carried by a traverse guided in said traveling beam, said traveling beam having side walls framing said traverse on opposite sides thereof over a path of said traverse in said traveling beam; and a main piston acting upon said traveling beam for displacing same toward said die, said side walls having recessed exteriors and being of a cross section diminishing from each end toward an intermediate region whereby, upon longitudinal stressing of said traveling beam for extrusion of a billet eccentricity of said ram is reduced.

2. The metal-extrusion press defined in claim 1 wherein said side walls have outwardly concave flanks.

* * * * *